US006394511B1

(12) United States Patent
Lam et al.

(10) Patent No.: US 6,394,511 B1
(45) Date of Patent: May 28, 2002

(54) AUTOMOTIVE VEHICLE DECKLID LATCH SYSTEM

(75) Inventors: Michael King Lam, Birmingham; James Joseph Loschiavo, Livonia; Bhupendra Patel, Canton, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/451,889

(22) Filed: Dec. 1, 1999

(51) Int. Cl.[7] ..... E05C 19/18

(52) U.S. Cl. ..... 292/336.3; 292/DIG. 43; 292/DIG. 65; 296/76

(58) Field of Search ..... 292/DIG. 43, DIG. 65, 292/336.3; 296/76

(56) References Cited

U.S. PATENT DOCUMENTS

| | | | | |
|---|---|---|---|---|
| 497,628 | A | | 5/1893 | Cathrein |
| 2,823,940 | A | | 2/1958 | Squire |
| D185,843 | S | | 8/1959 | James |
| 3,373,632 | A | | 3/1968 | Jeromson, Jr. et al. |
| 3,985,381 | A | | 10/1976 | Kobayashi |
| 3,992,909 | A | | 11/1976 | McGhee |
| 4,080,812 | A | | 3/1978 | Knott |
| 4,266,816 | A | | 5/1981 | Mukai et al. |
| 4,773,683 | A | | 9/1988 | Nakamura |
| 5,358,292 | A | | 10/1994 | Van Wiebe et al. |
| 5,445,326 | A | | 8/1995 | Ferro et al. |
| 5,515,247 | A | | 5/1996 | Cheung et al. |
| 5,709,453 | A | | 1/1998 | Krent et al. |
| 5,711,559 | A | | 1/1998 | Davis |
| 5,803,516 | A | | 9/1998 | Hempel |
| 5,885,300 | A | * | 3/1999 | Tokuhashi et al. ..... 606/99 |
| 6,086,131 | A | * | 7/2000 | Bingle et al. ..... 296/76 |
| 6,135,514 | A | * | 10/2000 | Kowalewski et al. ..... 292/216 |
| 6,152,502 | A | * | 11/2000 | Rossi ..... 292/347 |
| 6,159,101 | A | * | 12/2000 | Simpson ..... 463/46 |
| 6,193,301 | B1 | * | 2/2001 | Baumeier et al. ..... 296/121 |
| 6,209,933 | B1 | * | 4/2001 | Ang et al. ..... 292/336.3 |

FOREIGN PATENT DOCUMENTS

| | | |
|---|---|---|
| KR | 1546 | 7/1995 |
| KR | 2740 | 3/1998 |

* cited by examiner

*Primary Examiner*—Anthony Knight
*Assistant Examiner*—Matthew E. Rodgers
(74) *Attorney, Agent, or Firm*—David B. Kelley

(57) ABSTRACT

A truck latch system has a handle presented from the decklid within the trunk in substantially vertical fashion and is operative to move a trunk latch to an unlatched position when grasped and pulled in a generally downward direction to prevent the decklid from latching to a rear trunk wall and to unlatch the decklid from the trunk wall when latched thereto.

18 Claims, 3 Drawing Sheets

AUTOMOTIVE VEHICLE DECKLID LATCH SYSTEM

FIELD OF THE INVENTION

The present invention relates generally to automotive vehicle trunk decklid latch system, and more particularly to decklid latch systems releasable from within the trunk.

BACKGROUND OF THE INVENTION

It is well known for automotive vehicles to have an enclosed storage space, or trunk, usually at a rear portion of the vehicle. Typically, the trunk has a decklid which can be moved between an open position allowing access to the trunk and a closed position latched to a rear wall of the body structure.

It has been an accepted practice, both in the automotive industry and generally within society, to provide means for unlatching the decklid exteriorly from the trunk. That is, the trunk usually can be opened only through use of a key into the trunk lock from outside the trunk or by using a remote trunk latch actuator. Recently, however, it has been found desirable to have a mechanism for unlatching the decklid from within the trunk.

Various devices are known in the art permitting a decklid to be unlatched from within the trunk, including U.S. Pat. No. 4,080,812, (Knott), U.S. Pat. No. 3,992,909 (McGhee), U.S. Pat. No. 5,445,326 (Fero et al), Korean application 95-17630, and Korean application 98-2580. While these devices may allow the decklid to be unlatched from within the trunk, they do nothing to assist in preventing the decklid from being latched from within the trunk in the first place. Further, these devices do not optimally present the release mechanism to a person enclosed in the trunk.

SUMMARY OF THE INVENTION

The present invention addresses the deficiencies in the prior art by providing a trunk latch system with a handle presented from the decklid within the trunk in substantially vertical fashion and operative to move the latch to the unlatched position when grasped and pulled in a generally downward direction to prevent the decklid from latching to the rear trunk wall, and to unlatch the decklid from the rear trunk wall when latched thereto.

An advantage of the present invention is a trunk latch system for an automotive vehicle which may not be latched by grasping and pulling downward on a handle presented from an inner surface of the decklid.

Another advantage of the present invention is a trunk latch system which allows release of the latch from within the trunk when the decklid is in a closed position.

DETAILED DESCRIPTION OF THE PREFERRED EMBODIMENTS

Figure 1:
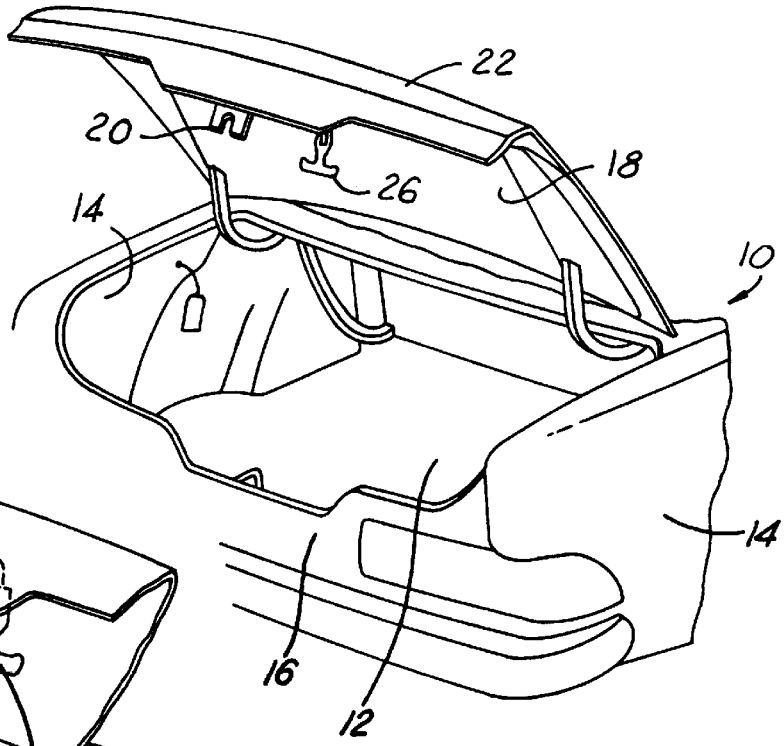
FIG. 1 is a perspective view of an automotive vehicle trunk showing a decklid in an open position allowing access to the trunk.
Figure 5:
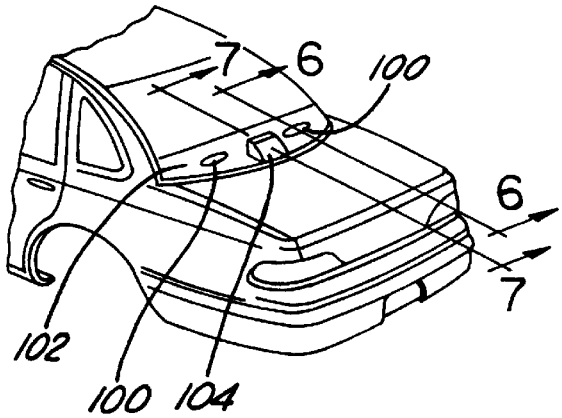
FIG. 5 is a perspective view of a rear portion of an automotive vehicle showing two means for allowing light into the trunk.

Turning now to the drawings, and in particular to FIG. 1 thereof, an automotive vehicle has a rear portion 10 with a trunk 12 defined by a pair of laterally opposed rear quarter panels 14, a rear trunk wall 16, and an opening for access thereto. The opening is closable by a decklid 18 which is movable between an open position (FIG. 1), and a closed position (FIG. 5). Within the trunk 12 may also be located a tab 19 attached by a cable 21 to a fuel filler door release mechanism (not shown). A latch 20 is mounted on a rear portion 22 of the decklid 18 for releaseably latching to a striker 24 on an inner surface of the rear wall 16 (FIG. 1). As further described below, the latch is movable between a latched position and unlatched position.

Figure 2A:
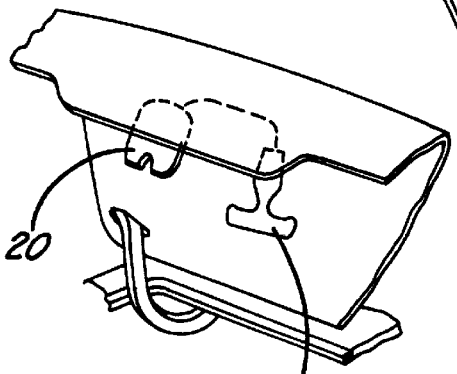
FIGS. 2A and 2B show perspective views, externally and internally of the trunk, respectively, of the handle orientation with respect to the decklid in the trunk latch system of the present invention.
Figure 2B:
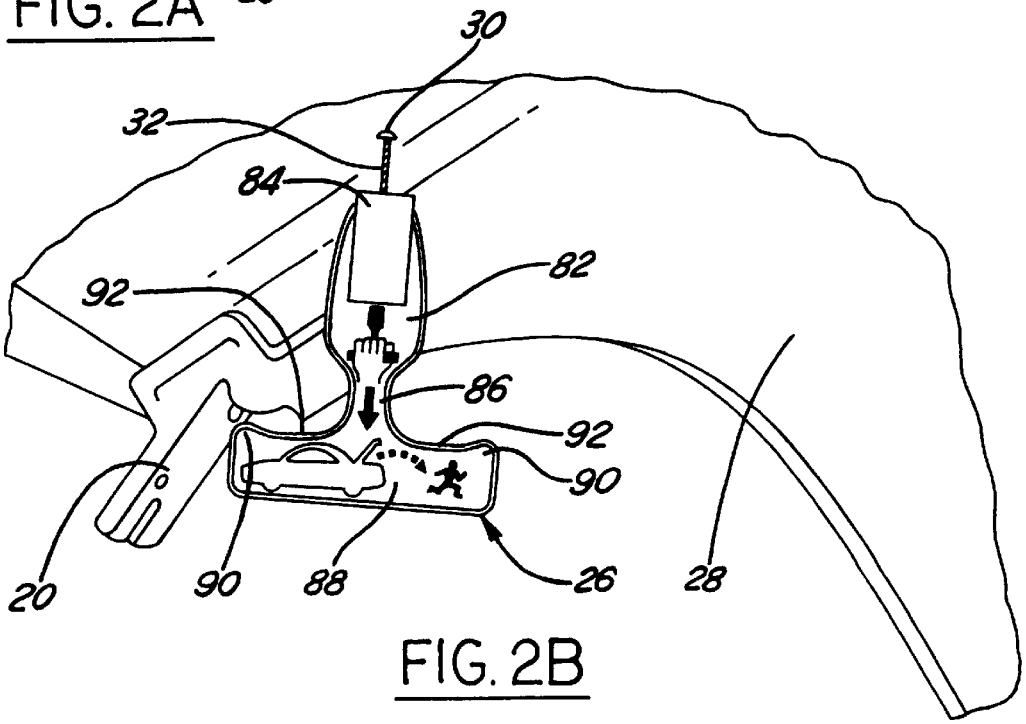

Operatively connected to the latch 20 is a handle 26 presented from the decklid 18 on an underside thereof in substantially vertical fashion and spaced from the latch 20 (FIGS. 2A and 2B). The handle 26 is operative to move the latch 20 to the unlatched position when grasped and pulled in a generally downward direction to prevent the decklid 18 from latching to the rear trunk wall 16, and to unlatch the decklid 18 from the rear trunk wall 16 when latched thereto.

It is important that the handle 26 be spaced from the latch 20 and presented in a substantially vertical position extending from an underside of the decklid 18 so as to be conspicuous when the decklid is in the closed position and when in the open position. In the latter circumstance, when the decklid is in the open position, pulling on the handle to close the decklid will prevent the latch 20 from engaging the striker 24 as further describe below. It is believed that the advantageous positioning of the handle 26 from the decklid 18 may induce grasping and pulling thereof, both when the decklid is latched in the closed position, and when the decklid is in the open position.

In a preferred embodiment, the decklid 18 has a trim piece 28 covering at least an underside portion thereof (FIG. 2B), and partially covering the latch 20. A connector opening 30 in the trim piece 28 allows the connector, for example, a cable 32, to pass therethrough for attachment to the handle 26. Other connectors may also be used as known in the art, such as levers.

Figure 3A:
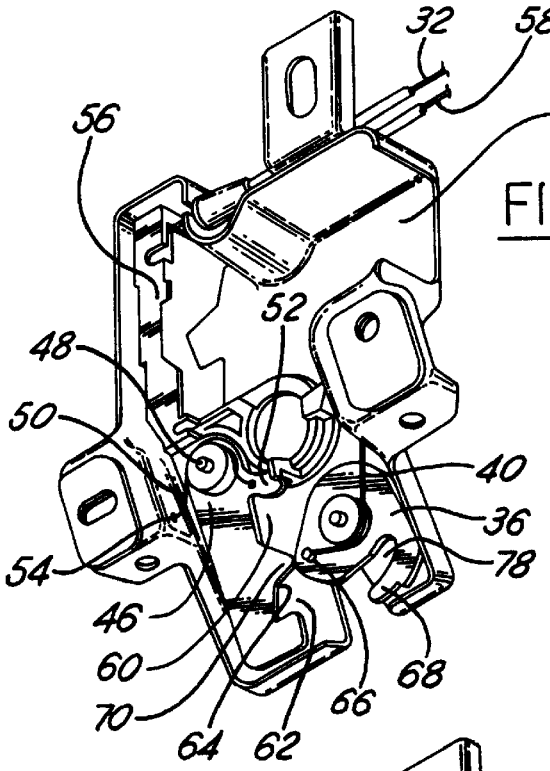
FIGS. 3A, 3B and 3C are internal, perspective views of a latch used in the trunk latch system of the present invention showing the latch in a non-mating, unlatched position, a mating, unlatched position, and a mating, latched position, respectively.
Figure 3B:
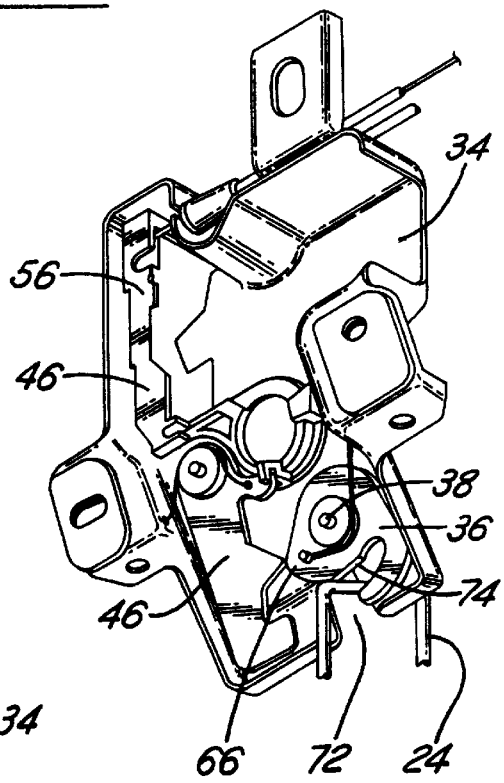
Figure 3C:
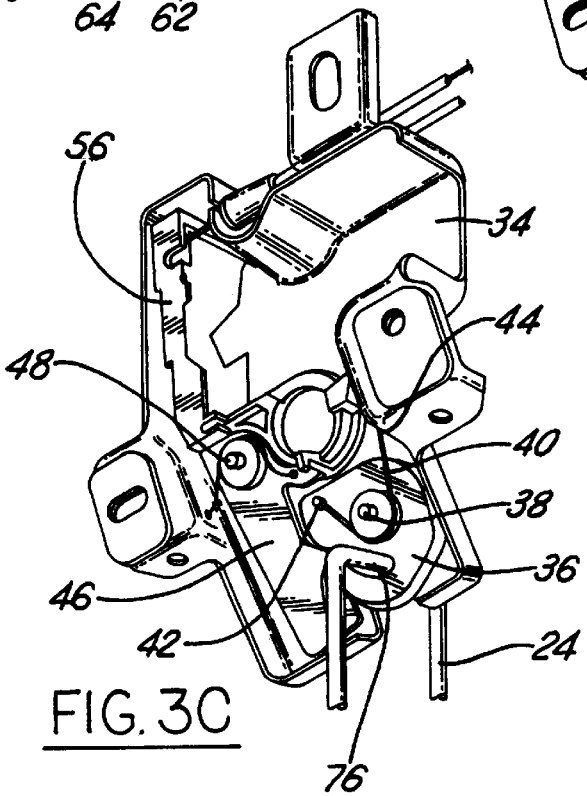

Referring now to FIGS. 3A–C, the latch 20 is shown having a casing 34 concealing various latch components attached thereto. The components include a catch 36 pivotally mounted at pivot 38 to the casing 34 for movement between an unlatched position disengaged from the striker 24 (FIGS. 3A and 3B), and a latched position engaging the striker 24 (FIG. 3C). The catch 36 is biased to the unlatched position by spring 40, which has a first end 42 attached to the catch 36 and a second end 44 attached to the casing 34 (FIG. 3C).

Another component of the latch 20 is a pawl 46 pivotally mounted at pivot 48 to the casing 34 for movement between an unengaged position allowing the catch 36 to move from the latched position (FIG. 3C) to the unlatched position (FIGS. 3A and 3B). The pawl 46 is biased to the engaged position by spring 50, which has a first end 52 attached to the pawl 46, and a second end 54 attached to the casing 36 (FIG. 3A). The pawl 46 has an upper extension 56 to which are attached operating mechanisms, such as cable 32 operatively associated with the handle 26, and a cable 58 which may be operatively associated with a remote trunk release mechanism such as a lever operated mechanism from within the vehicle passenger compartment or a remote transmitter device which operates a cable actuator. Other remote actuating devices may also be connected via the cable 58.

The pawl 46 also has notches 60, 62 along a catch facing edge 64 for receiving knob 66 and finger 68 on the catch 36, respectively (FIGS. 3A and 3C).

In operation, when the decklid is in the open position, unlatched from the trunk rear wall, the catch 36 moves to the unlatched position under the force of spring 40, and the pawl 46, which is in the unengaged position by virtue of operation of cable 32 or 58 acting upon pawl extension 56, as described above, is held in the unengaged position by interaction of knob 66 on catch 36 with knob 70 on pawl 46 (FIG. 3A). When the force on pawl 46 through pawl extension 56 from the cable 32 or 58 is released, spring 50 biases pawl 46 toward the catch 36. However, movement of pawl 46 is blocked by knob 66 interacting with knob 70.

As the decklid is moved toward the closed position, the striker 24 is aligned with an opening 72 in the housing 34 (FIG. 3B) and moves therethrough to contact a striker surface 74 on the knob 66 of catch 36. As the decklid is moved further downward, the striker 24 forces the catch 36 to rotate about pivot 38 against the force of spring 40 in a generally clockwise direction as viewed from FIG. 3B, until the crossmember 76 of the striker 24 engages a slot 78 formed between the knob 66 and finger 68 of the catch 36 (FIGS. 3A and 3C). As catch 36 rotates under the force of the striker 24, as described above, the knob 66 disengages from the knob 70 of the pawl 46 and mates with the notch 60 of pawl 46. Simultaneously, the finger 68 of the catch 36 mates with the notch 62 of the pawl 46 as the pawl 46 moves to the engaged position under the force of spring 50 (FIG. 3C). The catch 36 is thus in a latched position engaging the striker 24, and the pawl 46 prevents disengagement thereof by cooperative mating of the notches 60, 62 thereof with the knob 66 and finger 68 of the catch 36, as described above.

When the decklid is in the closed position latched as shown in FIG. 3C, release thereof may be accomplished by grasping the handle 26, which extends in a substantially vertical fashion from an inner surface of the decklid, and pulling in a generally downward direction. Such action will cause the pawl 46 to rotate about the pivot 48 from the engaged position (FIG. 3C) to the disengaged position (FIG. 3A), thus allowing the decklid to be opened from within the trunk. Alternatively, the cable 58 may force the pawl 46 from the engaged position to the disengaged position, as described above, allowing the decklid to move from the closed position to the opened position by an operation outside the trunk. Further, insertion of a key into a lock cylinder (not shown) associated with the latch may also effect unlatching of the decklid from outside of the trunk.

The present invention also advantageously may prevent closure of the decklid by a person within the trunk grasping the handle 26 and pulling in a generally downward direction. This results since pulling on handle 26 causes cable 32 to rotate pawl 46 to the disengaged position (FIG. 3A). As the decklid moves downward toward the striker 24, the crossmember 76 moves through the opening 72 to interact with the striker surface 74, as described above, rotating the catch 36 to a latched position (FIG. 3B). However, since pawl 46 remains in the disengaged position under the force of cable 32 via handle 26, catch 36 does not engage with pawl 46, as described above with reference to FIG. 3C, but rotates counterclockwise under the force of spring 40 to the unlatched position (FIG. 3A). Thus, a person attempting to use the handle 26 to close the decklid may be unable to effect latching of the decklid to the rear trunk wall. Such a feature results not only from the latch construction of the present invention but also more particularly from the handle 26 location relative to the latch 20 (FIGS. 1, 2A and 2B).

The handle 26 has been advantageously designed to allow a person within the trunk to locate, grasp and pull it so as to easily open the decklid. To this end, the handle 26 is preferably made of a phosphorescent material. Such a material may be energized by receiving light for a short period of time and is then operative to emit light for an extended period of time thereafter. The presentation of handle 26 in a vertical direction spaced from the latch also permits easy location thereof.

The handle 26 preferably has a shaft section 82 with a connection portion 84 for attachment to the cable 32 using means known to those skilled in the art, for example, a bead on the end of cable 32 attached in a groove-in-tongue combination. The handle 26 is preferably generally T-shaped (FIG. 2B) and includes a neck 86, of narrower width than shaft 82, connecting the shaft 82 with a grasp portion 88 generally perpendicular thereto (FIG. 2B). The grasp portion 88 has knurled corners 90 on a shaft-facing edge 92. It is believed that the combination thick shaft 82, narrower neck 86, and knurled grasp portion 88 comprising the T-shaped handle 26 facilitate grasping and retention of the handle 26 by a person within the trunk, both young and old.

To further facilitate use of the handle 26 by person within the trunk, the handle 26 may have informational images thereon to convey the purpose of the handle, and the direction it should be pulled. For example, an image of a vehicle with an open trunk and a caricature of a person jumping therefrom may be shown on the grasp portion 88, and an image of a hand grasping a handle and an arrow pointing in a downward direction may be placed on the shaft 82 and the neck 86, as seen in FIG. 2B. Preferably, the just-described images in black and the handle 26 is made of a yellowish phosphorescent material to highlight the informational images when glowing in the dark.

Figure 4:
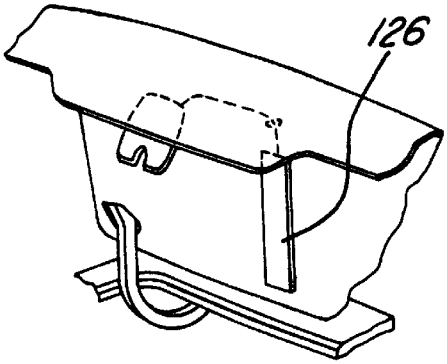
FIG. 4 is a perspective view of an alternative of an alternative handle embodiment for use with the trunk latch system of the present invention.

In an alternative embodiment shown in FIG. 4, the handle may comprise a tab 126. Those skilled in the art will appreciate that other handle shapes may also be used, the present invention not being limited to those shown herein.

Figure 6:
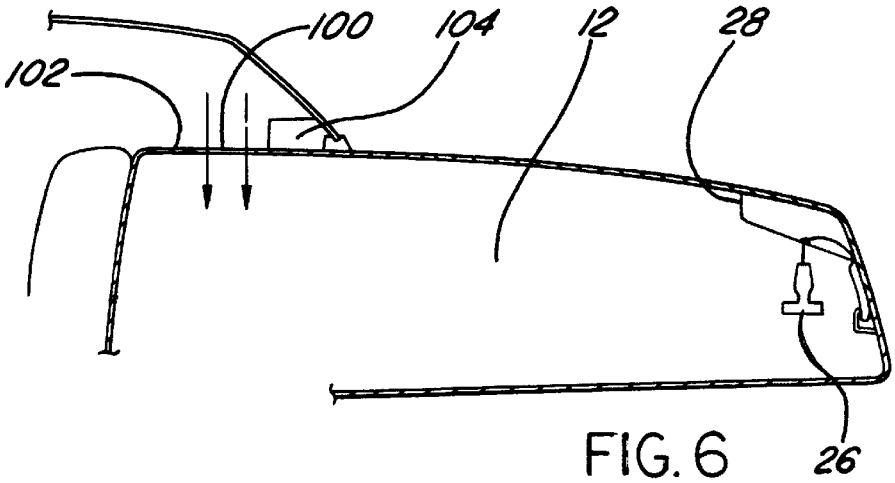
FIG. 6 is a sectional view taken along lines 6—6 of FIG. 5.
Figure 7:
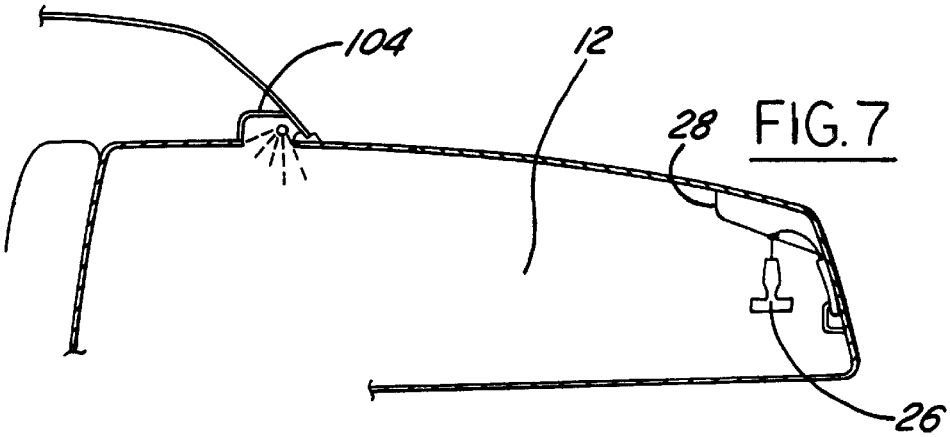
FIG. 7 is a sectional view taken along lines 7—7 of FIG. 5.

While in normal operation of a vehicle it is expected that handle 26 will receive sufficient light to energize the phosphorescent material of which it is made, it may be desirable, while not necessary, to provide additional light sources within the vehicle trunk to further energize the handle 26. One such light source includes providing openings 100 in a package tray 102 (FIGS. 5 and 6). The openings 100 would be in light communication with the trunk 12 and would convey light from the ambient to the trunk during the day and from a high mount stop lamp 104 at night (FIG. 6). Alternatively, the high mount stop lamp 104 may be configured to shine light directly into the trunk 20 in addition to shining light rearward (FIGS. 5 and 7).

The handle 26 may be made of a light colored material, for example, yellow, light green, green-yellow, orange, white, or other such colors. The informational images are preferably in a darker color, such as black, brown, dark blue, or other such colors to contrast with the color of the handle, particularly when illuminated in a dark trunk. Alternatively, the handle may be made of a dark material and the informational images may be of a phosphorescent material so as to illuminate in a dark trunk.

Although the preferred embodiments of the present invention have been disclosed, various changes and modifications may be made by one skilled in the art without departing from the scope and spirit of the invention as set forth in the appended claims.

What is claimed is:

1. A trunk latch system for an automotive vehicle having a trunk partially defined by a rear trunk wall and having a trunk opening closable by a trunk decklid, the system comprising:

a latch mounted on a rear portion of the decklid for releaseably latching to a striker mounted on the rear trunk wall, the latch movable between a latched position and an unlatched position; and a handle presented from the decklid within the trunk in substantially vertical fashion and operative to move the latch to the unlatched position when grasped and pulled in a generally downward direction to prevent the decklid from latching to the rear trunk wall, and to unlatch the decklid from the rear trunk wall when latched thereto.

2. A trunk latch system according to claim 1, wherein the decklid has a trim piece mounted on an underside thereof adjacent the latch with an aperture therein through which a latch actuating mechanism is routed for connection to the handle so as to present the handle in a spaced relationship from the latch.

3. A trunk system according to claim 1, wherein the handle is presented from the decklid a predetermined spaced distance from the latch.

4. A trunk latch system according to claim 3, including a trim piece adjacent the latch on an underside of the decklid for concealing the latch actuating mechanism and for presenting the handle in a substantially vertical position from the decklid.

5. A trunk latch system according to claim 1, wherein the latch is movable between a non-mating, unlatched position when the decklid is in an open position, a mating, unlatched position when the decklid is moved to the closed position by pulling on the handle, and a mating, latched position when the decklid is moved to the closed position other than by pulling on the handle.

6. A trunk latch system according to claim 1, wherein the handle is T-shaped.

7. A trunk latch system according to claim 1, wherein the handle is an elongate tab.

8. A trunk latch system according to claim 1, wherein the handle is made of phosphorescent material.

9. A trunk latch system according to claim 8, including light source means for illuminating the trunk to energize the phosphorescent material of the handle.

10. A trunk latch system according to claim 9, wherein the light source means comprises at least one opening in a package tray adjacent the trunk.

11. A trunk latch system according to claim 9, in which the light source means comprises a high mount stop light mounted above the trunk and an opening through which light enter s the trunk therefrom.

12. An interior trunk release system for an automotive vehicle having a trunk partially defined by a rear trunk wall and a decklid movable between an open position and a closed position, comprising:

a latch having a catch for operatively engaging a striker, the latch and the striker adapted to be oppositely mounted on the decklid and the rear trunk wall, the catch movable between a latched position engaged with the striker for holding the decklid in the closed position covering the trunk, and an unlatched position disengaged from the striker allowing the decklid to move to the open position;

a pawl in the latch movable between an engaged position engaged with the catch preventing movement of the catch from the latched position to the unlatched position and an unengaged position allowing the catch to move from the latched position to the unlatched position; and a handle presented from the decklid within the trunk in substantially vertical fashion, the handle operative to move the pawl between the engaged position and the unengaged positions, so that a tension force resulting from grasping the handle and pulling in a generally downward direction moves the pawl to the unengaged position preventing the decklid from latching to the rear trunk wall.

13. A trunk latch system for an automotive vehicle having a trunk partially defined by a rear trunk wall and having a trunk opening closable by a decklid, the system comprising:

a latch, adapted to be mounted on an interior surface of the decklid, having a catch and a pawl, the catch movable between a latched position engaging a striker located on the rear trunk wall to hold the decklid in a closed position and an unlatched position disengaged from the striker allowing the decklid to uncover the trunk open;

the pawl movable between an engaged position preventing movement of the catch from the latched position to the unlatched position and an unengaged position allowing the catch to move from the latched position to the unlatched position;

a handle suspended from an interior section of the decklid so as to extend substantially vertically therefrom when the decklid is in either the open position or the closed position covering the trunk; and the handle operative to move the pawl between the engaged and unengaged positions so that a tension force resulting from grasping the handle and pulling in a generally downward direction moves the pawl to the unengaged position preventing the catch, and thus the decklid, from latching to the rear trunk wall.

14. The trunk latch system according to claim 13, wherein the handle is generally T-shaped.

15. The trunk latch system according to claim 14, wherein the handle includes a shaft portion, a grasp portion generally perpendicular to the shaft portion, a neck portion narrower than the shaft portion connecting the grasp portion with the shaft portion, and knurled portions on opposed ends of the grasp portion along a shaft facing edge of the grasp portion.

16. The trunk latch system according to claim 15, wherein the handle is made of a phosphorescent material.

17. The trunk latch system according to claim 16, wherein the handle has informational images thereon.

18. The trunk latch system according to claim 17, wherein the handle is made of a light colored phosphorescent material and the informational images are in black.

* * * * *